US008887314B2

(12) United States Patent
Bormann-Early

(10) Patent No.: US 8,887,314 B2
(45) Date of Patent: Nov. 18, 2014

(54) NEEDLE STICK PREVENTION DEVICE

(75) Inventor: Pamela Lynn Bormann-Early, Fairview Park, OH (US)

(73) Assignee: The Cleveland Clinic Foundation, Cleveland, OH (US)

( * ) Notice: Subject to any disclaimer, the term of this patent is extended or adjusted under 35 U.S.C. 154(b) by 0 days.

(21) Appl. No.: 13/400,055

(22) Filed: Feb. 18, 2012

(65) Prior Publication Data

US 2012/0278964 A1 Nov. 8, 2012

Related U.S. Application Data

(60) Provisional application No. 61/518,217, filed on May 3, 2011.

(51) Int. Cl.
*A41D 13/08* (2006.01)

(52) U.S. Cl.
CPC ..... *A41D 13/087* (2013.01)
USPC ..... 2/21; 2/161.8

(58) Field of Classification Search
CPC ..... A41D 13/087; D05B 91/04; B25B 9/02; A61B 17/30; A61B 19/04; A61F 13/105
USPC ..... 2/21, 161.7, 161.8, 163, 20, 162, 161.3, 2/161.1, 167; 223/101; 606/210, 211, 606/205; 128/917; 602/22; 294/25
See application file for complete search history.

(56) References Cited

U.S. PATENT DOCUMENTS

| | | | | | |
|---|---|---|---|---|---|
| 88,708 | A | * | 4/1869 | Hall | |
| 136,157 | A | * | 2/1873 | Hall | 30/123.5 |
| 342,341 | A | * | 5/1886 | Edwards | 294/25 |
| 645,550 | A | * | 3/1900 | Clark | 30/123.5 |
| 666,666 | A | * | 1/1901 | Hackett | 30/175 |
| 1,235,199 | A | * | 7/1917 | Gavin | 2/21 |
| 1,316,292 | A | * | 9/1919 | Fleming | 2/21 |
| 1,362,461 | A | * | 12/1920 | Anast | 2/21 |
| 1,388,618 | A | * | 8/1921 | Stein et al. | 2/21 |
| 1,416,001 | A | * | 5/1922 | Detwiler | 2/21 |
| 1,483,595 | A | * | 2/1924 | Read | 473/205 |
| 1,516,385 | A | * | 11/1924 | Keck | 2/21 |
| 2,039,505 | A | * | 5/1936 | Vollmer | 2/21 |
| 2,651,776 | A | * | 9/1953 | Beatty | 2/16 |
| 4,796,302 | A | * | 1/1989 | Davis et al. | 2/21 |
| 5,002,561 | A | * | 3/1991 | Fisher | 606/210 |
| D374,509 | S | * | 10/1996 | Sullivan et al. | D29/114 |
| 5,644,797 | A | * | 7/1997 | Daneshvar | 2/161.7 |
| 5,706,520 | A | * | 1/1998 | Thornton et al. | 2/21 |
| D412,048 | S | * | 7/1999 | Schiazza | D2/610 |
| 6,009,557 | A | * | 1/2000 | Witta | 2/159 |

(Continued)

FOREIGN PATENT DOCUMENTS

| | | | |
|---|---|---|---|
| FR | 1369291 | A1 * | 8/1964 |
| GB | 269830 | A * | 4/1927 |

(Continued)

*Primary Examiner* — Amy Vanatta

(74) *Attorney, Agent, or Firm* — Tarolli, Sundheim, Covell & Tummino LLP

(57) ABSTRACT

The invention (C-Hold Safety Device) is designed to overcome the risk (e.g., needle sticks) currently associated with obtaining blood samples or inserting IV needles using C-Hold and other similar vein or arterial needle penetration procedures. The invention thus overcomes the reason for the prohibition of otherwise safe and efficient procedures for medical needle insertions.

16 Claims, 4 Drawing Sheets

(56) References Cited

U.S. PATENT DOCUMENTS

| | | | | |
|---|---|---|---|---|
| 6,145,128 | A * | 11/2000 | Suzuki | 2/21 |
| 6,175,962 | B1 * | 1/2001 | Michelson | 2/161.7 |
| 6,409,059 | B1 * | 6/2002 | Calvert | 223/101 |
| 6,684,406 | B2 * | 2/2004 | Fowler | 2/16 |
| 6,687,911 | B2 * | 2/2004 | Fitz | 2/21 |
| D524,489 | S * | 7/2006 | Scott | D29/113 |
| D533,314 | S * | 12/2006 | Schiazza | D29/113 |
| 2005/0236853 | A1 * | 10/2005 | Demetroulakos et al. | 294/99.2 |
| 2007/0210596 | A1 * | 9/2007 | Stewart et al. | 294/99.2 |
| 2011/0302684 | A1 * | 12/2011 | Logan | 2/21 |

FOREIGN PATENT DOCUMENTS

| | | | |
|---|---|---|---|
| GB | 2357422 | A * | 6/2001 |
| GB | 2496649 | A * | 5/2013 |
| JP | 2005232658 | A * | 9/2005 |

* cited by examiner

NEEDLE STICK PREVENTION DEVICE

This application claims the benefit of U.S. Provisional Patent Application No. 61/518,217 filed May 3, 2011, the entire contents of which are hereby incorporated by reference herein and made part of this specification.

BACKGROUND OF THE INVENTION

The invention generally refers to a device that prevents accidental needle penetration to a care giver during the process of blood sampling and intravenous fluid needle penetration by safely facilitating the "C" hold or "Window" hold needle stick technique.

DISCUSSION OF THE BACKGROUND

Hypodermic needles are in wide use to deliver medicines and fluids as well as to draw blood samples. There exists, each time a needle is used, the possibility of an inadvertent needle strike to the user; each accident representing a potential risk of contaminated blood to be transferred from the patient to the user.

Prior attempts to eliminate this potential life threatening problem have focused primarily on training to prevent the user from placing his or her hand in the proximity of the needle path, and cumbersome protective gloves or safety needle design that encloses or retracts the needle after the needle is retracted from the patient.

In the former means of prevention the user is forced to abandon the well known and efficient "C Hold" technique which results in an increase in multiple needle stick attempts to the patient and loss of time for the health care worker. The needle safety devices currently in the art are wholly unable to act as a defense against the accident that the present invention addresses. Rather they are primarily suited to prevent the accidental needle sticks that may occur during the disposal and breakage of the needles as intended to prevent reuse.

In the latter, the gloves available are not only cumbersome but expensive and nearly impossible to keep in a clean or sterile condition.

In general, many 'needle safety" improvements are known in the art, however, these improved needles add significant costs to the needle costs and significantly decrease user efficiency.

Thus there is a need in the art for an apparatus that permits for the safe use of needles. Such an apparatus should be easy to use.

BRIEF SUMMARY OF THE INVENTION

The present invention overcomes the disadvantages of prior art devices by providing a device that provides protection to the thumb and index finger.

Thus the present invention overcomes the reoccurring safety needle cost and cumbersome glove objections to improved user safety.

Certain embodiments provide a wearable device for a user including a material configured for covering the index finger (first finger) and thumb of the user. The material has an inner surface and an outer surface, such that said inner surface configured to facilitate donning. The device is sufficiently durable to protect the user from receiving a puncture wound.

In various embodiments, the device may include one or more flexible, semi-rigid, and/or rigid layers and may include a device to tether the layers to the user.

In certain other embodiments, the outer surface is textured, such that the device facilitates the griping of a patient's skin to increase the efficiency of safe needle insertion.

These features together with the various ancillary provisions and features which will become apparent to those skilled in the art from the following detailed description, are attained by the needle stick protection device of the present invention, preferred embodiments thereof being shown with reference to the accompanying drawings, by way of example only, wherein:

BRIEF DESCRIPTION OF THE DRAWINGS

FIG. 3 includes a magnified segment of the device to illustrate the inner and outer surfaces more clearly.

FIG. 4 includes a magnified segment of the device to illustrate the inner and outer materials and surfaces more clearly.

Reference symbols are used in the Figures to indicate certain components, aspects or features shown therein, with reference symbols common to more than one Figure indicating like components, aspects or features shown therein.

DETAILED DESCRIPTION

The invention will now be described as a device designed to overcome one of the risks (i.e., needle sticks) currently associated with obtaining blood samples or inserting IV needles using C-Hold and other similar vein or arterial needle penetration procedures. The invention thus overcomes the reason for the prohibition of otherwise safe and efficient procedures for medical needle insertions. It will be apparent that the present invention has a broader application for preventing cutting tool hand injuries, and is not meant to be limited by the discussion herein, except as provided in the Claims.

Figure 1:
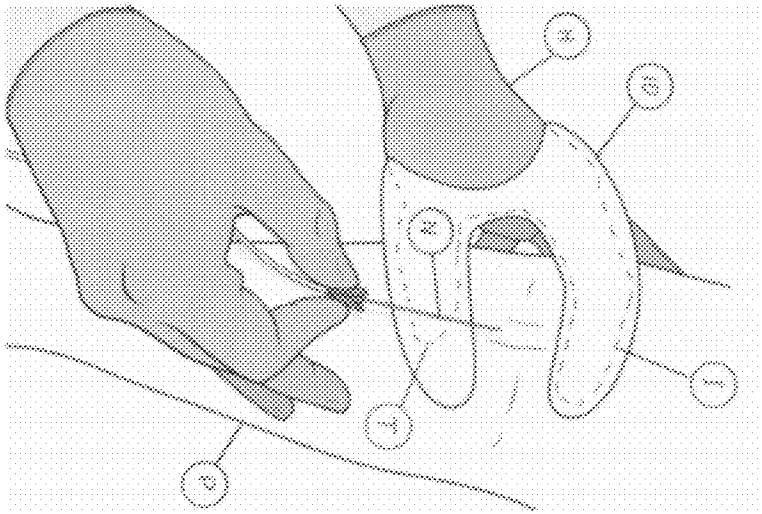
FIG. 1 is a top perspective view of one embodiment of the device, 10.

FIG. 1 is a top perspective view illustrating one embodiment of a device 10 as used to administer a needle N into a patient P. Device 10 is shown as being worn on the hand, H, of a user which is shown wearing a surgical glove, and more specifically over a user's left thumb, T. and index finger (first finger), I. As shown in the figure, device 10 provides protection from an accidental needle puncture to the user while inserting the needle, N.

Figure 2:
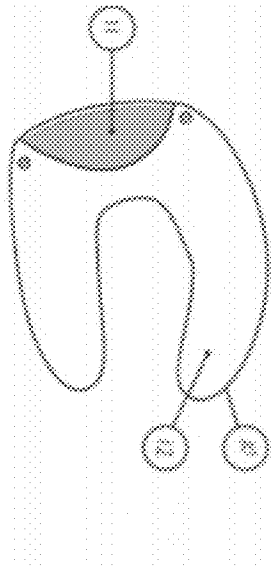
FIG. 2 is a top elevation of the device, 10, shown in FIG. 1 showing the general shape of the device.

FIG. 2 is a top elevation of the device shown in FIG. 1 showing the general shape of the device. Specifically, device 10 has a shape that is conformably donned over the user's thumb and index finger (first finger) without making the device difficult to put on or to remove. Device 10 can be equally manufactured in right or left hand configuration, but is optimally disposed to be suitable for use by either hand. Device 10 is shown in the "C" hold or "Window" technique whereby the vein is anchored by the thumb and first finger straddling the intended needle penetration site. In this technique the vein is prevented from 'rolling' and the skin above the vein is stretched tightly thus increasing the likelihood of a successful venial needle penetration. In alternate embodiments (FIG. 6, 7, 8, 9) device 10 may not completely enclose one or the other of the entire thumb or first finger.

Referring to FIG. 2 the protective device 10 has an inner surface 11 and an outer surface 12. Outer surface 12 has a gripping texture or is manufactured of a material with sufficient surface friction to facilitate the function of gripping the patient's skin in order to create a more pronounced venial presentation, thus enhancing the probability of a successful needle penetration. Inner surface 11 has a smooth surface that is optimally disposed to have a low surface friction to facilitate the donning and removal of device 10.

Figure 3:
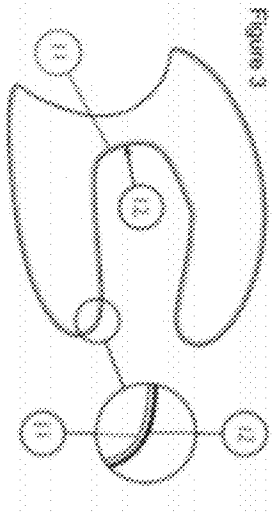
FIG. 3 is a cross section of FIG. 2 showing the preferred embodiment of the device manufactured of one material with an inside surface and an outside surface.
Figure 4:
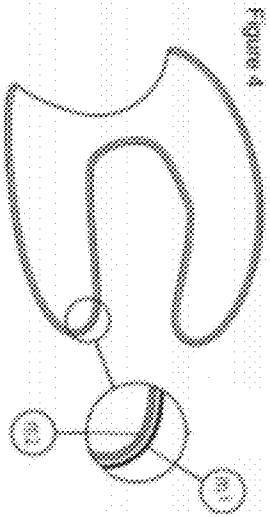
FIG. 4 is a cross section similar to FIG. 2 showing an alternate embodiment of the device manufactured of separate inner material and outer material.

FIGS. 3 and 4, are cross-sectional views of the embodiment of FIG. 2 showing alternative embodiments of device 10. FIG. 3 shows the device manufactured of one material. FIG. 4 shows the device manufactured of separate inner material, M2 and an outer material, M1. More specifically, device 10 of FIG. 4 shows the device manufactured with at least one inner material M2 and at least one outer material, M1 as required to optimize the functions of donning, gripping and removal. The inner and outer surfaces may or may not be of similar shape being optimized for protection and manufacturability. In one embodiment (FIG. 9) it is envisioned at least one layer may be segmented and then coated.

Figure 5:
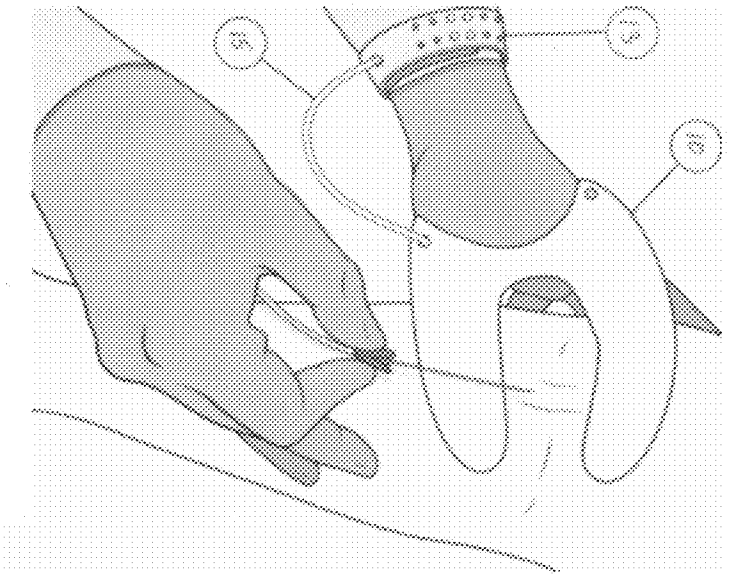
FIG. 5 is a second embodiment of the device showing a means of releasably assembling the device to the user's wrist.

FIG. 5 is a second embodiment of the device showing a means of releasably assembling the device to the user's wrist. Device 10 may be configured to have a securing device 15 durably fixed to the device 10 and a wristband 13 that is releasably assembled to the user's wrist. The assembly thus shown allows the device 10 to be removed from the index finger (first finger) and thumb of the user and remain readily accessible for the next use or for the entire assembly (10, 13, 15) to be removed from the wearer of the for cleaning or sterilization.

Figure 6:
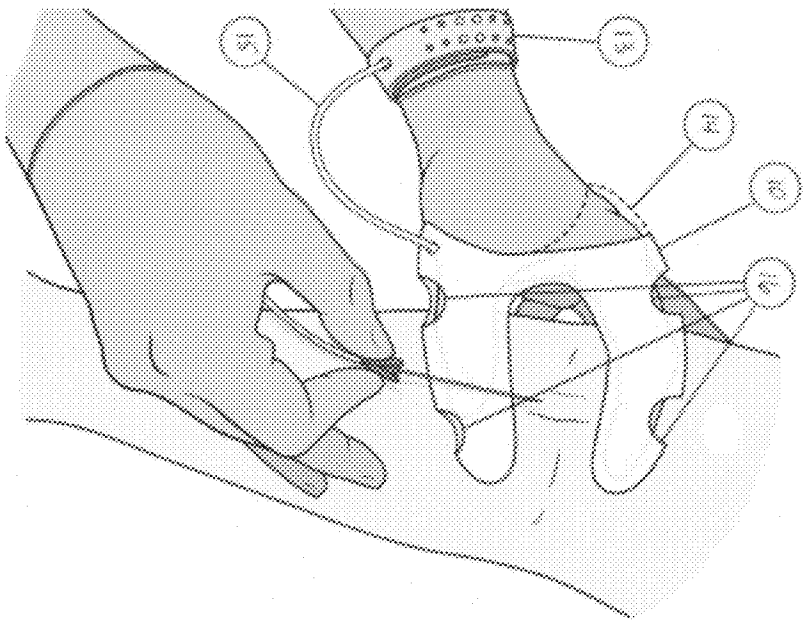
FIG. 6 is a third embodiment of the device showing a portion of the device removed to facilitate ease of donning and removal.

FIG. 6 is a third embodiment of device 10. As shown in FIG. 6, device 10 may be provided with certain portions of the first embodiment which are not required to provide the required protection to the wearer removed as manufactured, 16 and other portions trimmed, 14 by the user prior to donning as required to provide a custom and more comfortable fit to the user.

Figure 7:
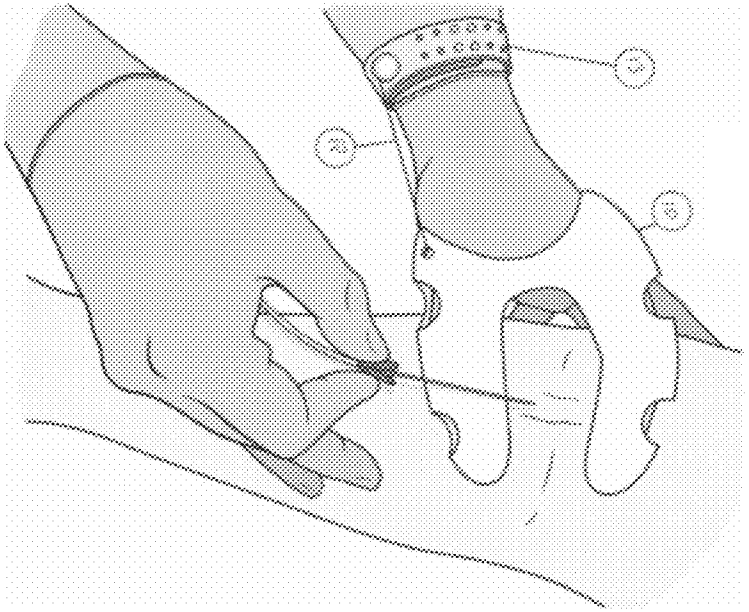
FIG. 7 is a fourth embodiment of the device showing a retractable means of communicating the device to the user.

FIG. 7 is a fourth embodiment of the device showing a retractable means, R, of communicating between the device 10 and the wrist assembly 13.

Figure 8:
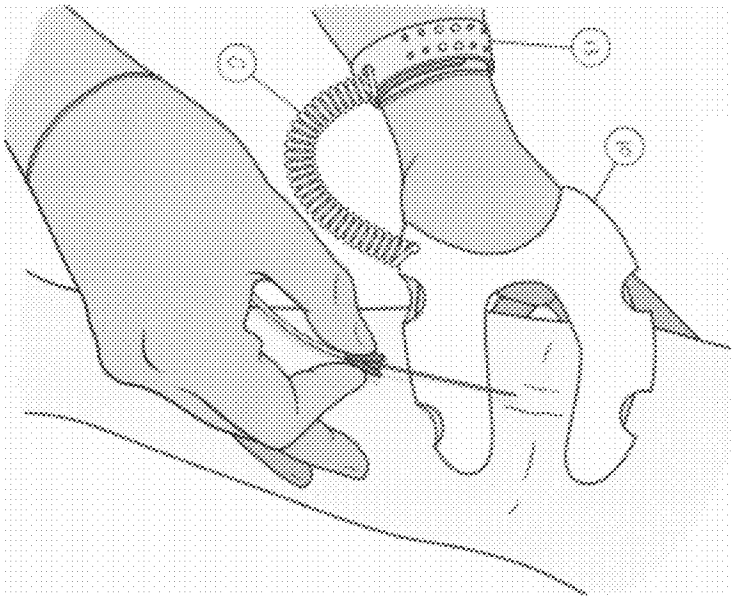
FIG. 8 is a fifth embodiment of the device showing a coiled means of retractably communicating the device to the user.

FIG. 8 is a fifth embodiment of the device showing a coiled, C, means of communicating between the device 10 and the wrist assembly 13.

Figure 9:
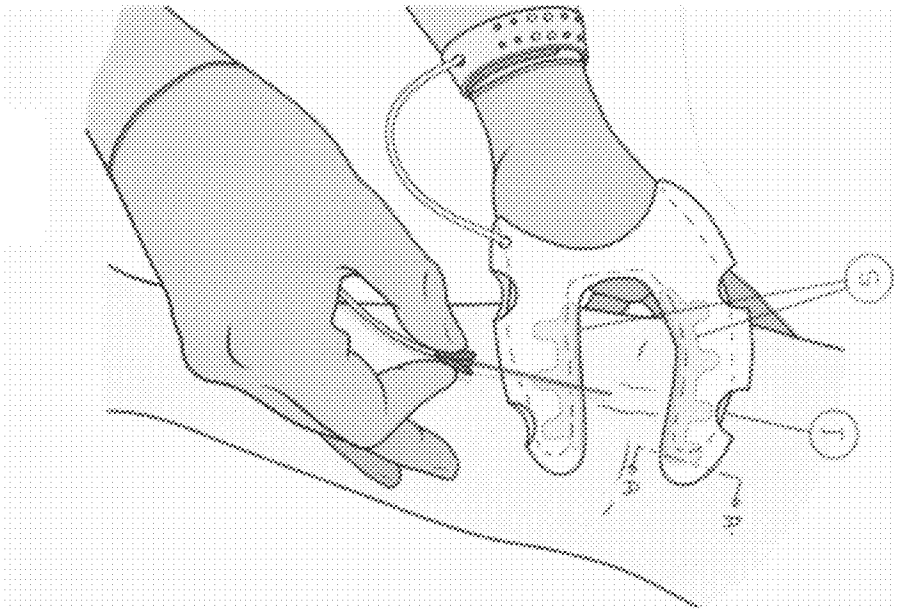
FIG. 9 is a sixth embodiment of the device showing the inclusion of a malleable insert within the device to further protect the wearer allowing thinner and penetrable outer materials for the outer layer(s) of the device.

FIG. 9 is a sixth embodiment of the device showing segmented insert(s), S, within the device 10 which act as a means of enhanced protection for the user and facilitates use of thinner penetrable materials to form the enclosure of the device.

Figure 10:
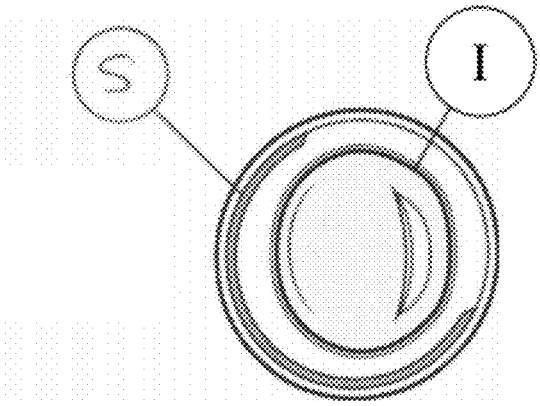
FIG. 10 is a cross section of the device as shown in FIG. 9 showing that the malleable material wraps around the thumb and/or index finger.

FIG. 10 is a cross section through plane A-A showing one of two segmented inserts wrapping partially around the index finger, I, to provide protection when an easily penetrated material is used to manufacture the outer layer of the device.

Alternate means of releasably securing the device to any user feature with either a flexible or retractable means of communication as known by persons with ordinary skill in the arts are also intended.

The device in its preferred embodiment is manufactured in a one-size-fits-all configuration and does not require a securing device.

The device described herein may be disposable and manufactured for a single use, or may be manufactured of durable material for multiple uses. The devices may be cleanable, sterile or sterilizable. Sterilization may be accomplished through sterilization techniques that are well known in the art, such as chemical, radiation, gamma ray, or heat sterilization methods. The device may be packaged as known in the art in a manner to maintain the sterile integrity of the device until they are used.

The device may be manufactured using any techniques known in the art, such as injection molding, rotational molding, blow molding, slurry coating or casting.

While the device has been shown in only some of its forms, it should be obvious to those skilled in the art that it is not limited, but is susceptible to various changes and modifications without departing from the scope of the invention. Accordingly, it is appropriate that the appended claims be construed broadly and in a manner consistent with the scope of the invention.

I claim:

1. A wearable device for a user, said device comprising:

a material comprising an index finger covering portion having a tubular shape with a closed distal end to completely enclose only the entire index finger, a thumb covering portion having a tubular shape with a closed distal end to completely enclose only the entire thumb, and a skin webbing covering portion with a closed distal end to completely enclose only the entire skin webbing extending between the thumb and the index finger, the skin webbing covering portion connecting the index finger covering portion to the thumb covering portion;

a wristband physically spaced apart from said material such that the skin between said material and said wristband is uncovered, said wristband being releasably connected to the user's wrist; and a securing device extending between, and physically connected to, each of said material and said wristband;

wherein said material has a smooth inner surface and a textured outer surface;

such that said outer surface creates a more pronounced venial presentation and facilitates the gripping of a patient's skin to increase the efficiency of needle penetration;

such that said inner surface is configured to facilitate donning and removal of said device; and such that said device is sufficiently durable to protect the user from receiving a puncture wound.

2. The device of claim 1, wherein said material may be trimmed to facilitate donning.

3. The device of claim 1, wherein said material is a single material.

4. The device of claim 1, wherein said device is comprised of at least two materials including an inner material and an outer material, where said inner material includes polyethylene or polypropylene and has a smooth or stippled surface finish to facilitate donning, and wherein said outer material includes a vinyl.

5. The device of claim 4, wherein one or more of said inner material or outer material is flexible.

6. The device of claim 4, wherein one or more of said inner material or outer material is rigid.

7. The device of claim 1, wherein said material is at least two layers including at least a first layer being a semi rigid or malleable segmented material, and at least a second layer comprised of a coated or co-molded material configured over the first material such that the device is optimized for flexibility and protection of the user and for comfort in use and ease of cleaning.

8. The device of claim 1, wherein the device is provided with portions removed to facilitate the user's comfort.

9. The device of claim 1, wherein said device is maintained in relationship to the user when not in use by means of said securing device.

10. The device of claim 4, wherein the device is provided with portions removed to facilitate the user's comfort.

11. The device of claim 4, wherein the device is maintained in relationship to the user when not in use by means of said securing device.

12. The device of claim 7, wherein the device is provided with portions removed to facilitate the user's comfort.

13. The device of claim 7, wherein the device is maintained in relationship to the user when not in use by means of said securing device.

14. The device of claim 4, wherein said vinyl is polyvinylchloride.

15. The device of claim 1, wherein said material does not have any apertures therethough.

16. A wearable device for a user, the device comprising:

a finger covering portion sufficiently durable to protect the user from receiving a puncture wound, the finger covering portion having a textured outer surface configured to create a more pronounced venial presentation and facilitate the gripping of a patient's skin to increase the efficiency of needle penetration, and a smooth inner surface configured to facilitate donning and removal of the device, the finger covering portion further comprising:

an index finger covering portion having a tubular shape with a closed distal end to completely enclose only the entire index finger; and a thumb covering portion having a tubular shape with a closed distal end to completely enclose only the entire thumb;

a skin webbing covering portion having a closed distal end to completely enclose only the entire skin webbing extending between the thumb and the index finger, the skin webbing covering portion connecting the index finger covering portion to the thumb covering portion, the skin webbing covering portion having a textured outer surface and a smooth inner surface;

a wristband physically spaced apart from the finger covering portion such that the skin between the finger covering portion and the wristband is uncovered, the wristband being releasably connected to the user's wrist; and a securing device extending between, and physically connected to, each of the finger covering portion and the wristband.

* * * * *